United States Patent [19]

McDonald

[11] 4,020,436

[45] Apr. 26, 1977

[54] LIFTING MAGNET FOR LAYERED PIPE

[75] Inventor: Donald C. McDonald, Sherborn, Mass.

[73] Assignee: O. S. Walker Company, Inc., Worcester, Mass.

[22] Filed: Apr. 11, 1975

[21] Appl. No.: 567,242

[52] U.S. Cl. ..... 335/286; 335/291

[51] Int. Cl.[2] ..... H01F 7/20

[58] Field of Search ..... 335/291, 285, 286, 290, 335/292, 289, 229, 295; 294/65.5

[56] References Cited

UNITED STATES PATENTS

| | | | |
|---|---|---|---|
| 762,759 | 6/1904 | Reuter | 335/291 |
| 1,937,216 | 11/1933 | Bahney | 335/290 |
| 3,120,631 | 2/1964 | Morgan | 335/291 |
| 3,363,209 | 1/1968 | Pevar | 335/286 |

FOREIGN PATENTS OR APPLICATIONS

| | | | |
|---|---|---|---|
| 482,876 | 5/1917 | France | 335/295 |

*Primary Examiner*—Harold Broome
*Attorney, Agent, or Firm*—Kenway & Jenney

[57] ABSTRACT

The lifting magnet disclosed herein is adapted for lifting layered pipe. The pipe is engaged by a pair of elongate pole pieces which extend transversely to the length of the pipe, the pole pieces being energized by at least one coil disposed therebetween. The pole pieces are of essentially uniform thickness over most of their length but have substantially thicker portions adjacent each end so as to provide, to a pipe contacting the ends of the pole pieces, an approach flux path of cross-sectional area substantially equal to the cross-sectional area of the approach flux path presented to a pipe contacting the pole pieces intermediate their ends.

1 Claim, 4 Drawing Figures

LIFTING MAGNET FOR LAYERED PIPE

BACKGROUND OF THE INVENTION

The present invention relates to lifting magnets and more particularly to a lifting magnet adapted for lifting layers from stacked pipe.

In general, lifting magnets provide an advantageous method of moving structural steel articles since the danger and expenditure of time associated with manually rigging chains or slings is avoided. For lifting steel pipe, various lifting magnet constructions have been devised which provide inclined pole pieces which engage the pipe parallel to its axis. Such constructions, however, typically limit the lifting of pipes to one piece at a time. In the loading and unloading of railroad cars, trucks, etc. filled with layered pipe, however, there is a considerable advantage obtainable if an entire layer of pipe can be picked up at one time.

Among the several objects of the present invention may be noted the provision of a lifting magnet for layered pipe and more particularly to such a construction which will lift an entire layer of pipe at a time. Other objects and features will be in part apparent and in part pointed out hereinafter.

SUMMARY OF THE INVENTION

Briefly, a lifting magnet constructed in accordance with the present invention is adapted for lifting layered pipe, the pipe being contacted by a pair of elongate pole pieces which are aligned parallel to each other and which are adapted to lie across a layer of stacked pipe extending transversely to the length of the pipe. The pole pieces are energized by means of one or more coils located therebetween. In accordance with the invention, the pole pieces are of essentially uniform thickness over most of their length but have substantially thicker portions adjacent each end. These thicker portions provide, to a pipe contacting the ends of the pole pieces, an approach flux path of cross-sectional area substantially equal to the cross-sectional area of the approach flux path presented to a pipe contacting the pole pieces intermediate their ends and also provide a similar contact area.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
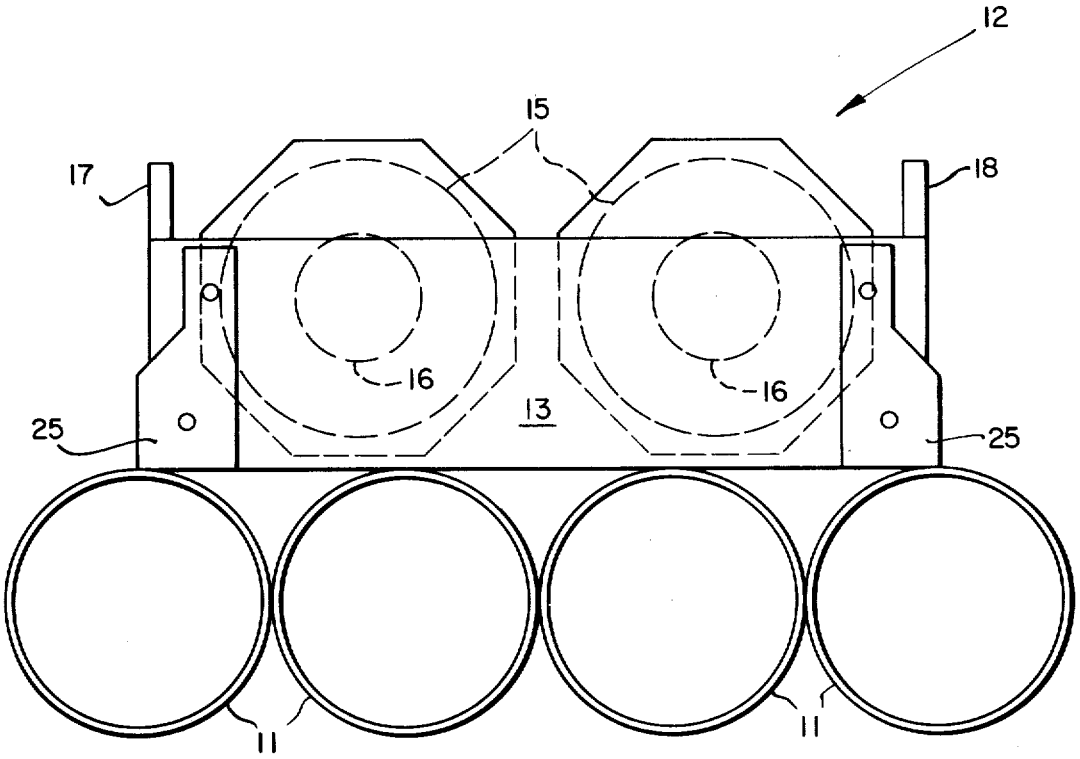
FIG. 1 shows a lifting magnet constructed in accordance with the present invention in engagement with a layer of steel pipe to be lifted, the view being end on with respect to the pipe.
Figure 2:
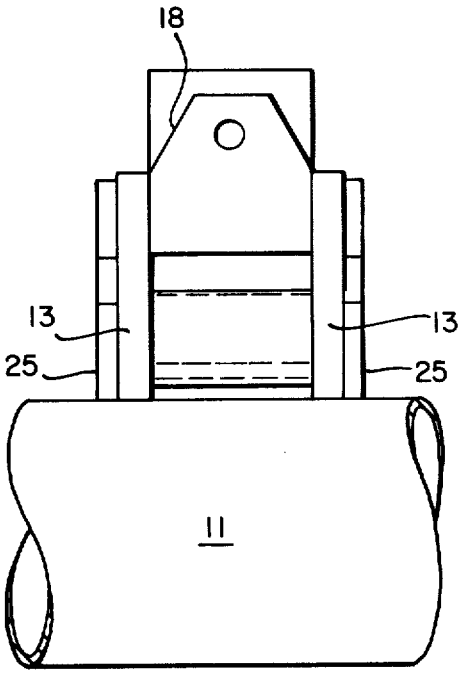
FIG. 2 is a side view of the pipe and lifting magnet of FIG. 1.
Figure 3:
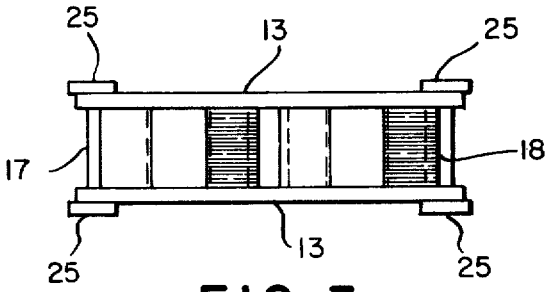
FIG. 3 is a bottom view of the lifting magnet.

As indicated previously, lifting magnets constructed in accordance with the present invention are particularly adapted for lifting layered pipe. In FIG. 1, such layered pipe is indicated at 11. The lifting magnet, designated generally by reference character 12, comprises a pair of elongate pole pieces 13 which are parallel to each other and adapted to contact the layered pipe 11 with the pole pieces extending transversely to the pipe. The pole pieces 13 are energized by means of a pair of coils 15 wound on cores 16 extending between the pole pieces. Attachment points for suspending the lifting magnet are indicated at 17 and 18.

While a single magnet has been illustrated for simplifying the description, the magnet of the present invention may be conveniently arranged in multiple magnet assemblies as described in the copending application of Donald McDonald for an invention entitled Plural Magnet Assembly, which application is being filed on essentially even date with the present application. Further, such plural magnet assemblies may be combined in arrays and advantageously suspended as disclosed in the copending application of Francis E. Whittaker entitled Magnetic Lifting Apparatus, which application is also being filed on essentially even date with the present application.

As the magnet arrangement of the present invention orients the pole pieces transversely to the axes of the layered pipes to be lifted, it can be seen that the effective contact area between the pipe and each pole piece is relatively small, i.e. with conventional magnetic materials, the effective contact area is limited to that portion of the pole piece face which is within about one-fourth inch of the pipe's surface. The nominal thickness of each pole piece is selected so that the necessary flux to achieve the desired lifting force can exit the pole piece through this area. As is pointed out in the copending application of Donald McDonald, identified previously, limitation of total flux may also occur due to the thickness of the pipe wall. Thus, it may be advantageous to use multiple magnet assemblies to raise the total flux to the desired or necessary level.

Figure 4:
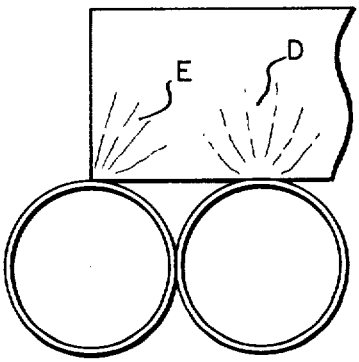
FIG. 4 is a diagram illustrating flux paths within a lifting magnet pole piece.

As illustrated in FIG. 4, the flux exiting through the contact area approaches the effective contact area from both directions along the length of the pole piece when the pipe contacts the pole pieces intermediate their ends, e.g. as indicated at D in FIG. 4. For a pipe engaging the pole pieces at or near their ends, however, flux can approach the exit area through the pole piece only from one side, i.e. as illustrated at E in FIG. 4. Further, when a pipe is essentially centered beneath the edge of a pole piece, the length of the contact is about halved.

In order to provide an approach flux path of cross-sectional area equal to that available elsewhere along the length of the pole pieces, the construction of the present invention provides thickeners 25 at the ends of the pole pieces 13. Thickeners 25 increase the effective thickness of the pole pieces 13 in a direction parallel to the axis of the pipe so that the approach flux path cross-sectional area presented to a pipe at the ends of the pole pieces is substantially equal to the cross-sectional area of the approach flux path presented to a pipe contacting the pole pieces intermediate their ends. The thickeners also provide a corresponding increase in contact area, particularly for a pipe which is centered below the end of a pole piece. In the embodiment illustrated, the thickneners 25 are constructed as separate pieces secured to the main pole piece plates 13 by bolts or welds. However, as will be understood by those skilled in the art, the thickened portions could be provided integrally with the overall pole piece. By thickening the pole pieces in this manner, whether by separate thickener or integrally, and thereby providing an increased thickness in a direction parallel to the axis of the pipe, an increased cross-sectional area, available as an approach flux path, is provided to a pipe contacting the pole pieces at their ends, which increased area is substantially equal to the cross-sectional area of the approach flux path presented to a pipe contacting the pole pieces intermediate their ends. The thickener also compensates for the reduced length of the actual contact area for a pipe at the end of the pole piece. In other words, the increased thickness along the pipe axis compensates or makes up for the inavailability of flux approach from the direction which is not available when the pipe contacts the pole pieces at their ends. In general, a thickening which increases the overall thickness 50–100% is appropriate.

In view of the foregoing, it may be seen that several objects of the present invention are achieved and other advantageous results have been attained.

As various changes could be made in the above constructions without departing from the scope of the invention, it should be understood that all matter contained in the above description or shown in the accompanying drawings shall be interpreted as illustrative and not in a limiting sense.

What is claimed is:

1. A lifting magnet for layered pipe, said magnet comprising:

a pair of elongate, flat pole pieces, said pole pieces being essentially parallel to each other and to a vertical plane and having flat bottom edge surfaces adapted to lie across a layer of stacked pipe, with the pole pieces oriented horizontally transversely to the length of the pipe so that the effective area of each magnetic contact is thus determined by the curvature of the surface of the pipe and the thickness of the pole piece;

between said pole pieces, at least one coil for generating a magnetomotive potential between the pole pieces, said pole pieces being of essentially uniform thickness over most of their length but having substantially thicker portions adjacent each end providing, to a pipe contacting the ends of the pole pieces, an effective contact area of cross-sectional area substantially equal to the cross-sectional area of the effective contact area presented to a pipe contacting the pole pieces intermediate their ends so that the magnet can exert a substantially equal lifting force on all pipes it contacts.

* * * * *